US005437080A

United States Patent [19]

Stummer

[11] Patent Number: 5,437,080

[45] Date of Patent: Aug. 1, 1995

[54] DEVICE FOR OPENING FLOCCULENT FIBROUS MATERIAL

[76] Inventor: Josef Stummer, Schulstrasse 3, D-55595 Roxheim, Germany

[21] Appl. No.: 117,056

[22] PCT Filed: Aug. 20, 1993

[86] PCT No.: PCT/DE92/00119

§ 371 Date: Aug. 20, 1993

§ 102(e) Date: Aug. 20, 1993

[87] PCT Pub. No.: WO92/14872

PCT Pub. Date: Sep. 3, 1992

[30] Foreign Application Priority Data

Feb. 20, 1991 [DE] Germany ..... 41 05 189.0

[51] Int. Cl.[6] ..... D01G 9/06

[52] U.S. Cl. ..... 19/26; 19/28; 19/34; 19/80 A

[58] Field of Search ..... 19/24, 26, 48 A, 80 A, 19/94, 16, 28, 33, 34

[56] References Cited

U.S. PATENT DOCUMENTS

| | | | |
|---|---|---|---|
| 431,665 | 7/1980 | Marshall | 19/80 A |
| 2,747,232 | 5/1956 | Armstrong | 19/26 |
| 3,872,545 | 3/1975 | Altosaar | 19/26 |
| 4,369,548 | 1/1983 | Malinak | 19/26 |

FOREIGN PATENT DOCUMENTS

| | | |
|---|---|---|
| 929253 | 12/1947 | France . |
| 1303869 | 8/1962 | France . |
| 100033 | 3/1898 | Germany . |
| 478760 | 1/1938 | Germany . |
| 1151453 | 7/1963 | Germany . |
| 996604 | 6/1965 | Germany . |
| 1009284 | 11/1965 | Germany . |
| D01G9/04 | 4/1985 | Germany . |

*Primary Examiner*—John J. Calvert
*Attorney, Agent, or Firm*—Spencer, Frank & Schneider

[57] ABSTRACT

A device for opening flocculent fibrous materials, including a housing and a supply connection pipe having an end extending into a lower portion of the housing for introducing into the housing a negative pressure transport air current conveying fiber flocks. A hollow cylinder is provided that has one end connected to the end of the supply connection pipe, an open end opposite to the one end, and a diameter larger than a diameter of the end of the supply connection pipe. The hollow cylinder forms an annular chamber within the housing. The device further includes a discharge connection pipe connectable to the housing for discharging the fibrous material. The housing, supply connection pipe, hollow cylinder and discharge connection pipe collectively define a pneumatic conveying path for the fibrous material. Additionally provided is a drivable opening disc disposed within the housing and positioned at a distance from and parallel to the open end of the hollow cylinder to extend across the open end. The disc includes a plurality of pointed spikes each projecting towards the hollow cylinder for processing material as it is conveyed along the pneumatic conveying path.

16 Claims, 5 Drawing Sheets

DEVICE FOR OPENING FLOCCULENT FIBROUS MATERIAL

BACKGROUND OF THE INVENTION

The invention relates to a device for opening flocculent fibrous material of natural or synthetic fibres, which device is incorporated with a supply connecting conduit and a discharge connecting conduit in a pneumatic conveying path for the processing of the fibrous material.

Such devices are known in various forms. For example, from DE-33 33 750 A1 a device is known for opening and cleaning fibrous goods having two rollers lying opposite each other, which have above a lattice of rods or a grating or the like, and have below a closed covering hood, arranged parallel in a horizontal plane, and provided with spikes or the like, in which the entry and exit openings are so arranged that the fibrous goods are conducted in and out by an air stream in a direction lying parallel to the rollers. Such arrangements operating with spiked rollers require a large standing area, and with a low throughput, have a bad degree of opening and are subject to high wear. Also there arises the danger of coils of the fibres forming on the rollers with consequent blocking of these.

SUMMARY OF THE INVENTION

The invention is based on the object of providing a device of the above known type, which with simple and compact construction would assure a high degree of effectivity and avoid occurrence of build-up of fibres in the region of the opener.

This object is met according to the invention using a hollow cylinder open at the top, and connected to the supply conduit, which extends into a cylindrical housing connected with the discharge conduit and with formation of an annular chamber, so that at a certain distance from and parallel to and covering the free front face of the hollow cylinder, there is arranged a driven opening disc, which is provided in the direction towards the hollow cylinder with pointed spikes.

The substantial advantages realized with the device of the invention consist of a small standing area, a favourable degree of opening, less parts to build and to wear out, and a higher performance. The fibre-carrying airstream which has entered through the supply conduit proceeds after passing through the hollow cylinder, out of the open front face, and is then engaged with the opener disc rotating at relatively high speed, so that the flocculent fibrous material is opened by the spikes of the opened opener disc, and because of centrifugal force, is led together with the air through the peripheral exit slot and between the opening disc and the hollow cylinder, over into the annular chamber, from which the fibre-airstream is then sucked out and away via the discharge conduit. Since with this procedure the fibrous material is subject when in the region of the opener disc to a high centrifugal force, there is no coiling up on the opener disc.

In order to increase the efficiency of the opener disc, according to a refinement of the invention a stationary counter-opener disc having the form of a segment of a circle is installed at the front face of the hollow cylinder, which counter-opener-disc is equipped with pointed spikes. In this way the fibre-carrying airstream is guided to the opener disc in a form compressed over a certain area, and the counter-opener disc in cooperation with the opener disc takes care of an assured opening of the fibrous material.

In order that the fibre-airstream as it leaves the hollow cylinder does not impact a central region of the opener disc, the fibres according to a further development of the invention pass through the segmentally formed counter-opener disc at a distance from the diameter of the counter-disc, which is defined by a circumferential angle of about 200 degrees. Thereby more than a half of the front face of the hollow cylinder is closed off by the counter-opener disc.

For improving the opening action, according to an advantageous further development of the invention, the counter-opener-disc is provided with spikes over only an angular range of about 120 degrees. Desirably the spikes of the counter-opener-disc are arranged to extend in radial rows extending outwardly from a central area free of spikes. Moreover, it is preferred that the spikes of the counter-opener-disc are inclined in the direction of the rotation of the opener-disc. For further increase in the opening action, it is desirable that the spikes of the opener-disc are arranged to extend from a central area unoccupied by spikes outwards to the periphery in sickle- or crescent-shaped rows, and preferably also the spikes of the opener-disc are installed to be slanting outwards.

In an advantageous refinement of the object of the invention, the opener-disc is surrounded by a ring-shaped flange fixed to the lid of the housing, and a shield extending over the circumference of the spiked region of the counter-opener-disc and attached to the hollow cylinder, lies slidingly on the exterior of the ring-shaped flange. By use of the shield, the fibrous material cannot be prematurely carried away from the spiked region by centrifugal force. At the same time, the ring-shaped flange prevents fibres from being deposited above the opener-disc.

In addition, by an advantageous refinement of the solution of the invention, the opener-disc is connected at its central area via a support flange to a drive shaft. This shaft extends through a bearing block attached on the lid of the housing, and at its end carries a drive wheel coupled over a gearbox to a drive motor. The result is an altogether more compact drive for the opener-disc. Obviously a direct drive to the opener-disc is possible.

In order to avoid occurrence of an under-pressure above the opener-disc, according to a further refinement of the invention, air discharge openings are let into the lid of the housing, which openings discharge into the space defined by the opener-disc and the ring-shaped flange.

Furthermore, it is preferably arranged for the lower part of the hollow cylinder, of diameter greater than that of the supply-connector-pipe, to be of truncated conical shape. This causes a slowing down of the rising fibre-airstream, by which heavy fibre flakes are swirled around inside the hollow cylinder, which leads to their becoming loosened up.

In order that the efficiency of the device on fibre-airstreams of various intensities can be matched in the simplest possible way, by an advantagepoous development of the inventive object the supply-connector-pipe which is connected inside the housing with the hollow cylinder, is received in a height-adjustable manner in a ring-shaped flange attached to the outer face of the housing floor. Desirably the adjustment in height of the supply-connector-pipe carrying the hollow cylinder is achieved by means of a rack-and-pinion gear. Thus there is obtained a simple adjustment of the distance between the opener-disc and the counter-opener-disc, so that the opening effect can be adapted to the particular fibre-airstream.

For avoidance of deposits of fibres on the housing floor, according to a further advantageous refinement of the invention, the lower region of the housing extends conically to join with the floor of the housing, and it is from this region that the discharge-connector-pipe exits tangentially. Preferably also a fresh air supply pipe fitted with an adjustable flap is arranged to feed into the conical region of the housing at a location opposite the discharge-connector-pipe. By this means, it is possible by the feeding in of fresh air, to prevent layerings of fibres forming in the region of the housing floor.

BRIEF DESCRIPTION OF THE DRAWINGS

The fundamental idea of the invention will be further explained in an example of an embodiment, which is shown in the drawings. There are shown in.

DESCRIPTION OF A PREFERRED EMBODIMENT

Figure 5:
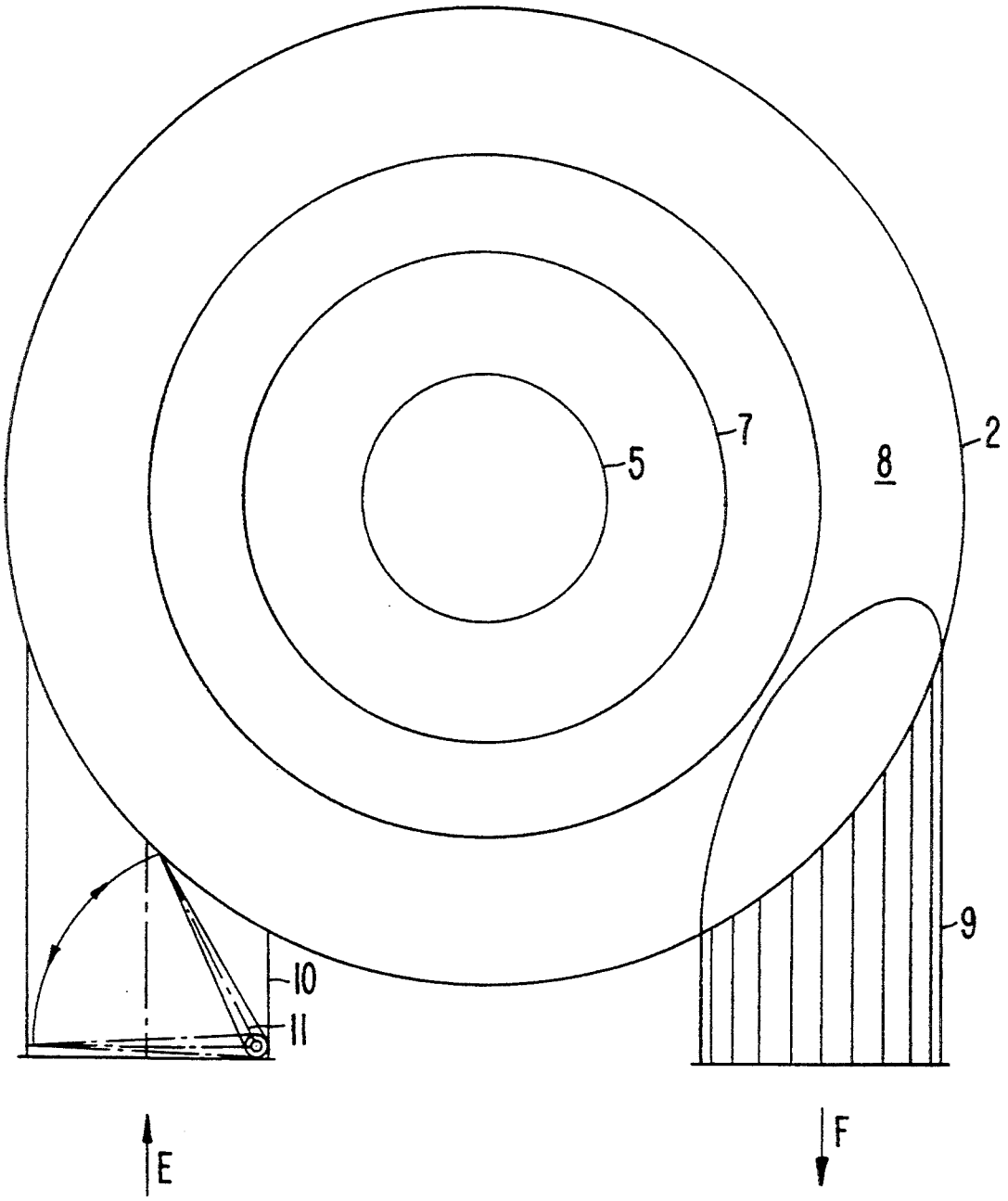

The device 1 comprises a cylindrical housing 2 of which a lower part is shaped conically to extend on into the floor 3 of the housing 2. On the exterior of floor 3 of the housing 2, there is centrally located an annular flange 4 in which a supply connection pipe 5 is slidingly lodges so as to extend into the housing 2. The variable position of the supply pipe 5 inside the annular flange 4 is selectable by means of a rack drive 6 coupled to it. A conveyer air stream loaded with fibre flakes flows under continuous section through the supply connection pipe 5 into the device 1, from a machine (not shown) which feeds the fibre flakes in the direction of the arrow D. Inside the housing 2 the supply connection pipe 5 is connected to a hollow cylinder 7, whereby the flower region of the hollow cylinder 7 extends onwards from the supply pipe 5 in a frustro-conical form. The walls of the hollow cylinder 7 and the housing 2 extend parallel to each other, and form between them an annular chamber 8, from a lower part of which a discharge connection pipe 9 exits tangentially. Moreover, a fresh air connecting pipe 10 (shown in FIG. 5) feeds into the lower part of an annular chamber 8 tangentially and at a location opposite the discharge pipe. In order to guide the fresh air into the annular chamber 8 this pipe has an adjustable vane 11. Thereby, fresh air can flow in the direction of the arrow E into the annular chamber 8, while avoiding deposition of fibres. A suction conduit from a fan not shown is connected to the discharge connection pipe 9.

The housing 2 comprises on the outside and at its upper end a surrounding annular flange 12, which is attached to an annular cover disc 14 by screws distributed evenly around the periphery. The opening 15 in the annular cover disc 14 is closed by a lid 16 which lies thereon. Distributed uniformly over this circumference, screw fasteners 17 secure the lid in place. A drive shaft 18 for an opener disc located inside the housing 2 extends centrally through the lid 16. The drive shaft 18 is supported from a bearing 20 which is accommodated in a bearing block 21 and an associated bearing cover 22 attached on the outside of the lid 16. The end of the drive shaft 18 projects above the bearing cover 22 and is fixed non-rotatably to a drive wheel 23 which can be engaged through a gearbox to a drive motor.

Figure 1:
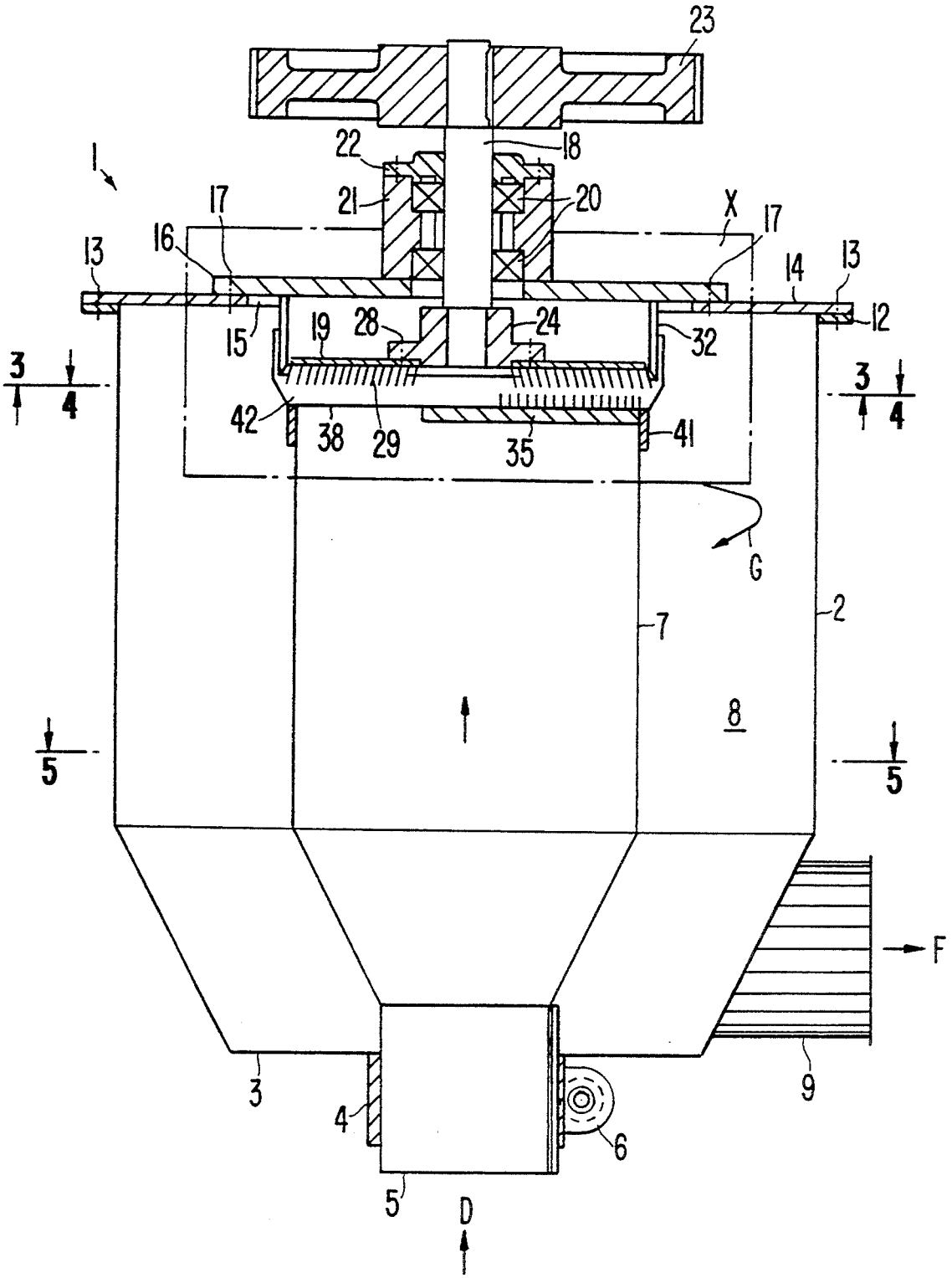
FIG. 1 a longitudinal section through a device according to the invention.
Figure 2:
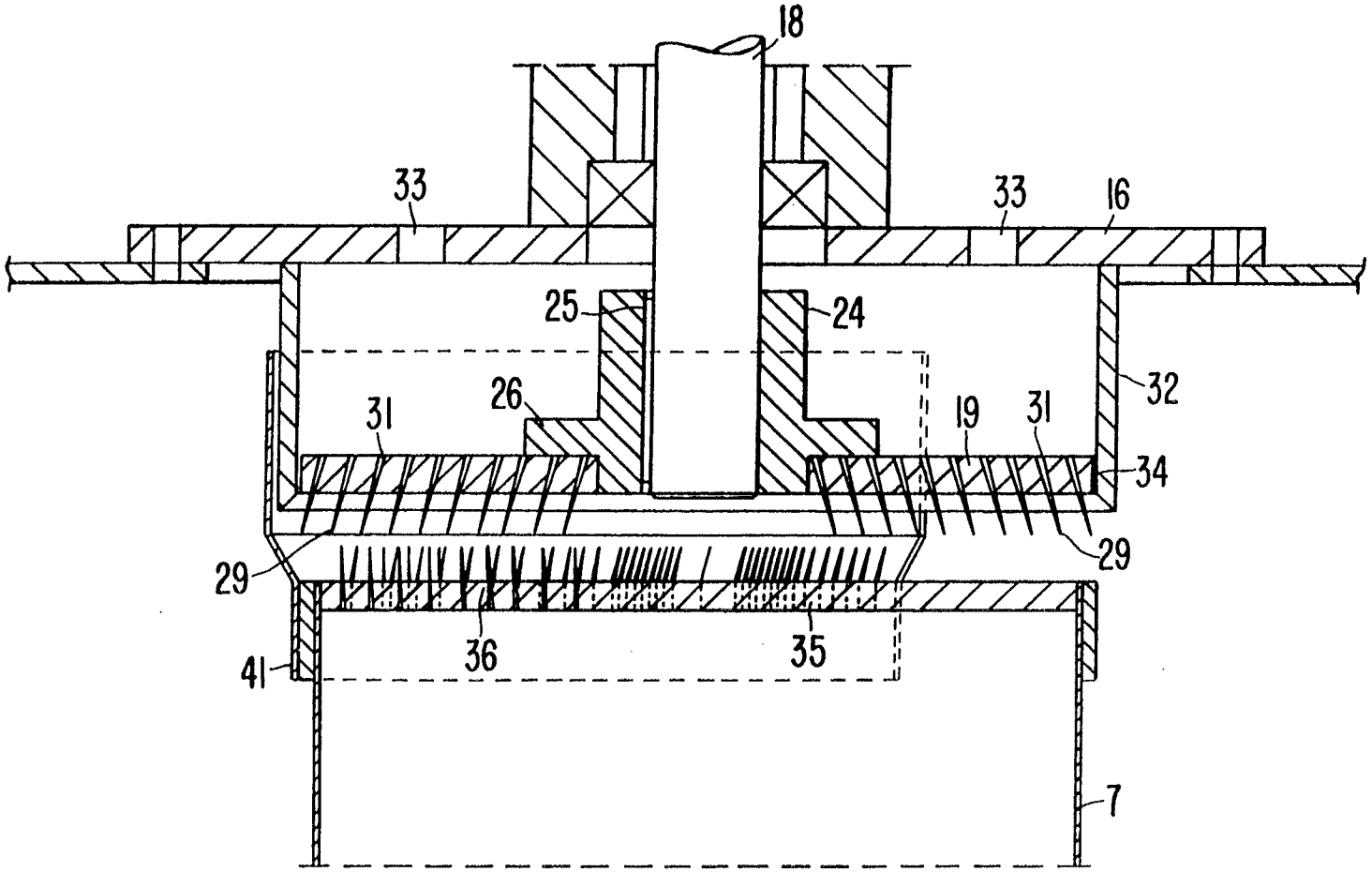
FIG. 2 an enlarged view of the detail 'X' of FIG. 1 in a section turned through 90 deg, FIG. 3 a view on the opener disc in the direction of the line 3—3 of FIG. 1, FIG. 3*a* a view of the opener disc of FIG. 3 in the direction of the arrow III, FIG. 4 a view on the counter-opener disc of the device of FIG. 1 taken on the line 4—4, FIG. 4*a* a view of the counter-opener-disc of FIG. 4 taken on the arrow IV, and in FIG. 5 a cross-section through the device of FIG. 1 taken on the line 5—5.
Figure 3A:
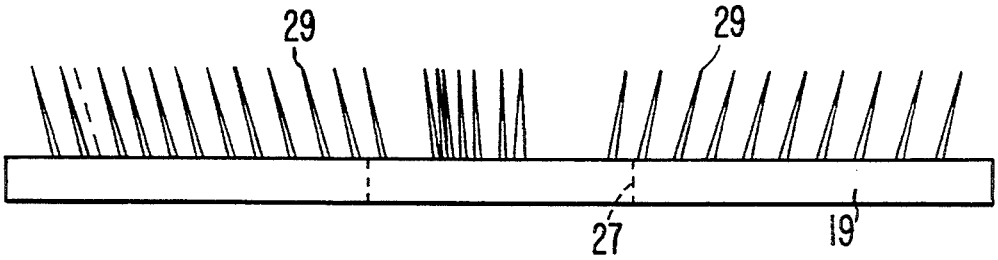
Figure 3:
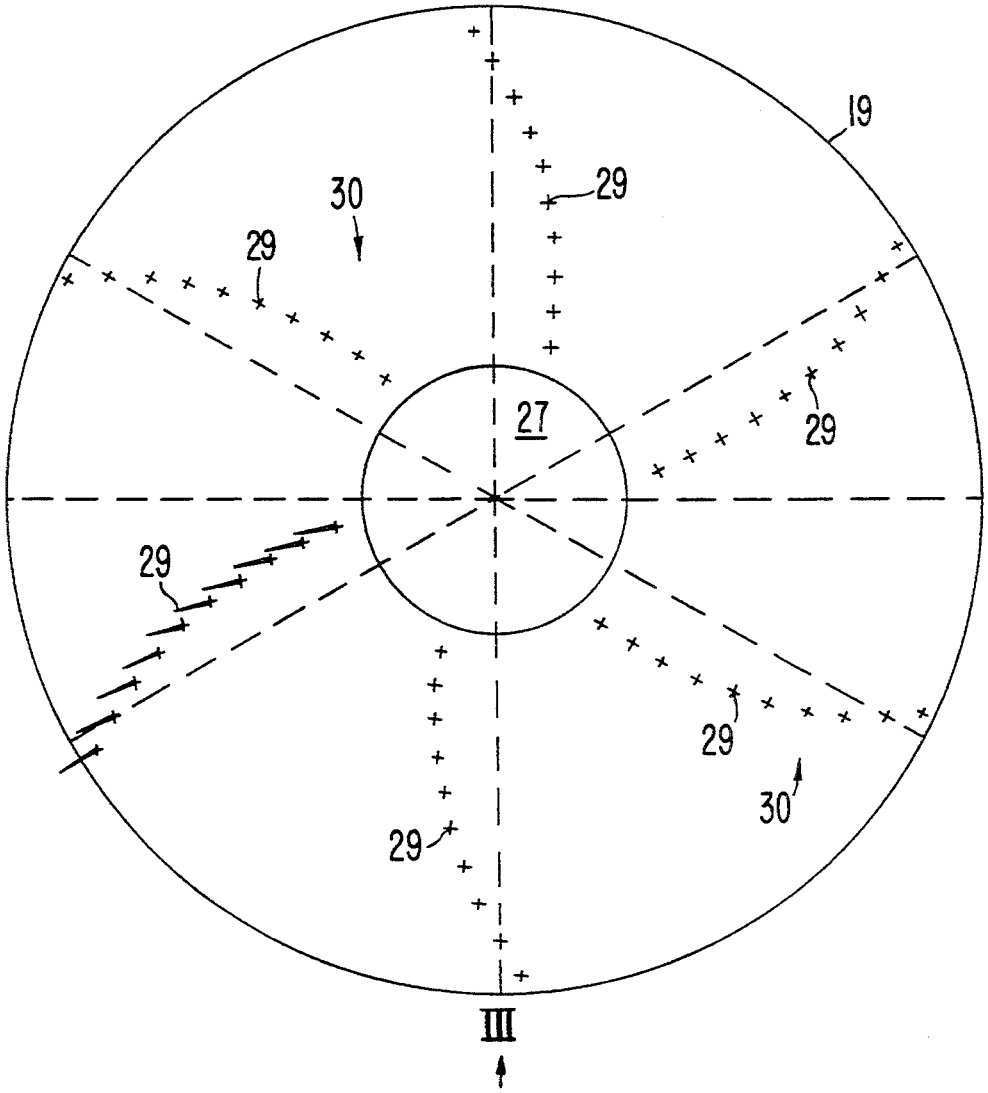
Figure 4A:
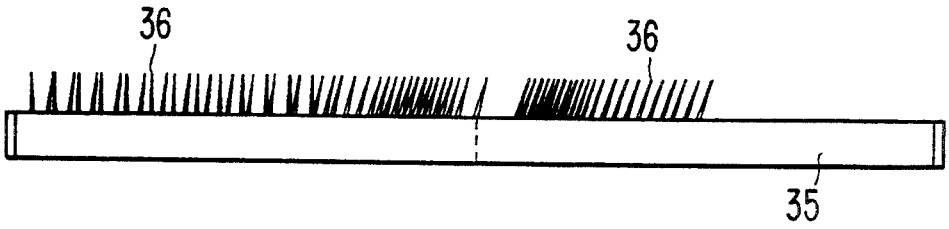
Figure 4:
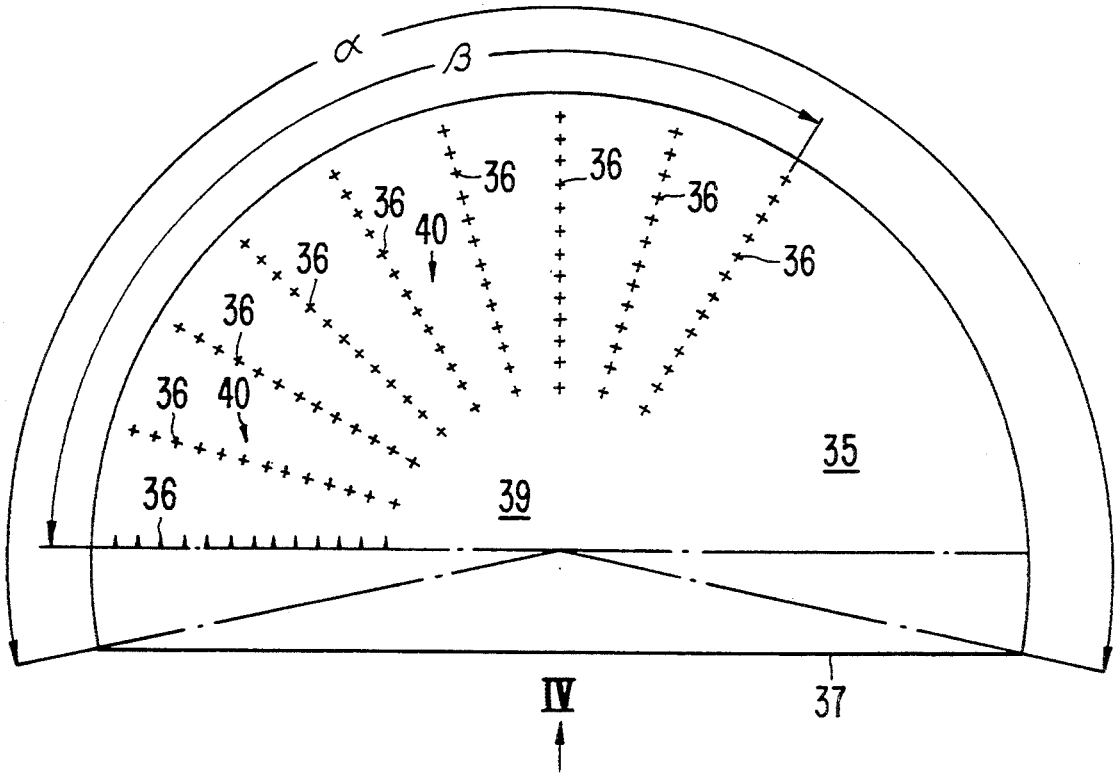

The end of the drive shaft 18 which extends into the housing 2 carries rotatably fixed therewith a support flange 24 for the opener disc 19. The support flange 24 is attached to the drive shaft 18 by a groove-and-spring joint 25 (FIG. 2) and has an integral annular shoulder 26, whose distance from the outer side of the support flange 24, which lies flush with the end of drive shaft 18, corresponds with the thickness of the opener disc 19. The opener disc lies on the annular shoulder 26, with the result that the support flange 24 extends fittingly into a central bore 27 (FIGS. 3 and 3*a*) in the opener disc 19.

Distributed uniformly over the circumference of the annular shoulder 26 are screw fasteners 28 which secure the opener-disc 19 to the annular shoulder 26. The opener-disc 19 is designed to be slightly larger in diameter than the hollow cylinder 7 and is equipped with pointed spikes 29 on its face oriented toward the hollow cylinder 7, which spikes slope outwardly. The spikes 29 are distributed on the opener-disc 19 in a pattern of six sickle-shaped lines 30. To this end, the spikes are inserted into correspondingly sloped bores 31 in the opener disc 19. A ring-shaped flange 32 attached to the inner face of the lid 16 surrounds the opener disc concentrically. Oppositely located to the opener disc 19 are air removal holes 33 which have been let into the lid 16 with even distribution round the circumference. In this way, there is no build-up of deposited fibres in the space bounded by the opener disc 19, the ring-shaped flange 32 and the lid 16, because a suction force is set up in the annular gap 34 between the opener disc 19 and the ring-shaped flange 32, which suction is caused by the fibre-airstream slipping past the underside of the opener disc 19.

The hollow cylinder 7, which is arranged coaxially with the opener disc 19, ends with its free front face at a certain parallel spacing from the opener disc 19, by which arrangement this spacing may be adjusted with the aid of the rack gear drive 6 in accordance with the nature of the fibre-loaded airstream, to realize an optimum degree of opening. Opposite the opener disc 19, there is situated a circular segment shaped counter-opener disc 35 which is inserted into the front face of the hollow cylinder 7. The counter-opener-disc 35 is stationary, and is fitted with pointed spikes 36. Further, and edge 37 of counter-opener-disc 35 is defined by an chord that extends at a distance from a diameter of counter-opener-disc 35 to enclose a circumferential angle $\alpha$ (alpha) of about 200 degrees, ie the counter-opener-disc closes off more than half of the front face of the hollow cylinder 7. Resulting from this, the exit opening is reduced in size, and guides the fibre-airstream in a compressed state to the opener-disc 19, which in cooperation with the counter-opener disc 35 opens the fibrous material. The spikes 36 of the counter opener disc, which are arranged to be slanting in the direction of rotation of the opener disc 19, are distributed in radial lines 40 outwardly from an unoccupied region 39 over the upper face of the counter opener disc 35, such that the spikes are arranged only over an angular range $\beta$ of about 120 degrees from the diameter of the counter opener disc 35. In order to increase the dwell time of the fibrous material between the opener disc 19 and the counter-opener-disc 35, a circular segment shaped shield 41 is fixed on the exterior of the hollow cylinder 7, and the free end of shield 41 is slidable on the outside of the ring-shaped flange 32, which has been mounted on the lid 16. The shield 41 extends however only over the angular range $\beta$ corresponding to the spikes on the counter opener disc 35, so that an angular range of 240 degrees is left for the exit 42 of the fibrous material between the opener disc 19 and the counter opener disc 35. From the exit 42 the fibre-air-stream progresses in the direction of the arrow G in a winding path inside the annular chamber 8 to the discharge connection pipe 9 and leaves the latter in the direction of the arrow F. The preceding description with reference to the drawings has clarified the device as to its details and to its use. It will be understood by those skilled, however, that the fundamental idea of the present invention can be applied substantially more widely, and is not limited to the example of the embodiment specifically considered herein.

What I claim is:

1. A device for opening flocculent fibrous materials, comprising:

a housing;

a supply connection pipe having an end extending into a lower portion of said housing for introducing a suction created transport air current into said housing and for conveying fiber flocks;

a hollow cylinder having: one end connected to the end of said supply connection pipe, an open end opposite to the one end and a diameter larger than a diameter of the end of said supply connection pipe, the hollow cylinder forming an annular chamber within said housing;

a discharge connection pipe connectable to said housing for discharging the fibrous material, said housing, supply connection pipe, hollow cylinder and discharge connection pipe collectively defining a pneumatic conveying path for the fibrous material; and a drivable opening disc disposed within said housing and positioned at a distance from and parallel to the open end of the hollow cylinder and extending across the open end, said disc including a plurality of pointed spikes each projecting towards the hollow cylinder for processing material as the material is conveyed along the pneumatic conveying path.

2. A device according to claim 1, further comprising a fixed, circular segment-shaped counter-opener-disc inserted in the open end of the hollow cylinder, the counter-opener-disc including a plurality of pointed spikes each projecting in a direction of the drivable opening disc.

3. A device according to claim 2, wherein an edge of the circular segment shaped counter-opener-disc is defined by a chord that extends at a distance from a diameter of the counter-opener-disc to enclose a circumferential angle of about 200 degrees.

4. A device according to claim 3, wherein the counter-opener-disc is provided with spikes only over an angular range of about 120 degrees.

5. A device according to claim 4, wherein the spikes on the counter-opener-disc are arranged to extend in radial rows outward from a vacant central area located on the counter-opener-disc.

6. A device according to claim 5, wherein the spikes on the counter-opener-disc are attached thereto and are inclined in a direction of rotation of the opening disc.

7. A device according to claim 6, wherein the spikes of the opening disc are arranged to extend in sickle-shaped rows outwardly from a vacant central area to a periphery of the opening disc.

8. A device according to claim 7, wherein the spikes of the opening disc are applied thereto so as to slope outwardly.

9. A device according to claim 2, further comprising a ring-shaped flange fixed to a lid of the housing, and a shield fixed to the hollow cylinder and extending past a circumference of a spiked region of the counter-opener-disc, said shield being slidable over an outer surface of the ring-shaped flange, said ring shaped flange and said shield surrounding said opening disc.

10. A device according to claim 1, further comprising a support flange a drive shaft, and a bearing block attached on a lid of the housing, the drive shaft extending through the bearing block and carrying at an end a driving wheel coupled through a gearbox to a driving motor, said opening disc having a central area connected to said drive shaft via said support flange.

11. A device according to claim 1, further comprising a housing lid having air discharge holes therein, the holes opening into a space bounded by the opening disc and a ring-shaped flange fixed to the lid.

12. A device according to claim 1, wherein a lower region of the hollow cylinder has a truncated conical shape.

13. A device according to claim 12, wherein the supply connection pipe, is received in a ring-shaped flange so as to be adjustable in height, said ring-shaped flange being fixed to an exterior of a floor of the housing.

14. A device according to claim 1, further comprising a rack and pinion gear for adjusting a height of the supply connection pipe.

15. A device according to claim 1, wherein a lower region of the housing has a conical shape, said lower region joining a floor of the housing and having the discharge connection pipe exiting tangentially therefrom.

16. A device according to claim 1, further comprising a fresh-air supply pipe provided with an adjustable vane feeding into the lower portion of the housing and being opposite to the discharge connection pipe.

* * * * *